United States Patent [19]

Hill et al.

[11] 4,018,599

[45] Apr. 19, 1977

[54] ELECTRICAL CONTACTS OF DISPERSION STRENGTHENED GOLD

[75] Inventors: James S. Hill, Cranford; Emil L. Carbone, Paramus; Victor G. Mooradian, Summit; Walter G. Keyes, Spotswood, all of N.J.

[73] Assignee: Engelhard Minerals & Chemicals Corporation, Murray Hill, N.J.

[22] Filed: Sept. 5, 1975

[21] Appl. No.: 610,526

[52] U.S. Cl. ..... 75/165; 200/266

[51] Int. Cl.[2] ..... C22C 5/02

[58] Field of Search ..... 75/165; 200/266

[56] References Cited

UNITED STATES PATENTS

| | | | |
|---|---|---|---|
| 2,370,242 | 2/1945 | Hensel et al. | 75/165 |
| 2,396,101 | 3/1946 | Hensel et al. | 75/165 |
| 2,425,052 | 8/1947 | Swinehart | 200/266 |
| 2,490,214 | 12/1949 | Hensel et al. | 75/165 |
| 3,515,542 | 6/1970 | Larsen | 75/165 |
| 3,606,766 | 9/1971 | Hill | 75/165 |
| 3,622,310 | 11/1971 | Reinacher et al. | 75/165 |

FOREIGN PATENTS OR APPLICATIONS

| | | | |
|---|---|---|---|
| 542,630 | 6/1957 | Canada | 75/173 A |

*Primary Examiner*—L. Dewayne Rutledge
*Assistant Examiner*—E. L. Weise

[57] ABSTRACT

Small concentrations of certain dispersed oxides such as $CeO_2$ substantially improve the electrical contact properties of gold. Gold with dispersed $CeO_2$ is superior to gold for use as an electrical contact because of much greater resistance to arc erosion and welding and only slightly higher contact resistance.

4 Claims, 1 Drawing Figure

ELECTRICAL CONTACTS OF DISPERSION STRENGTHENED GOLD

BACKGROUND OF THE INVENTION

Figure 1:
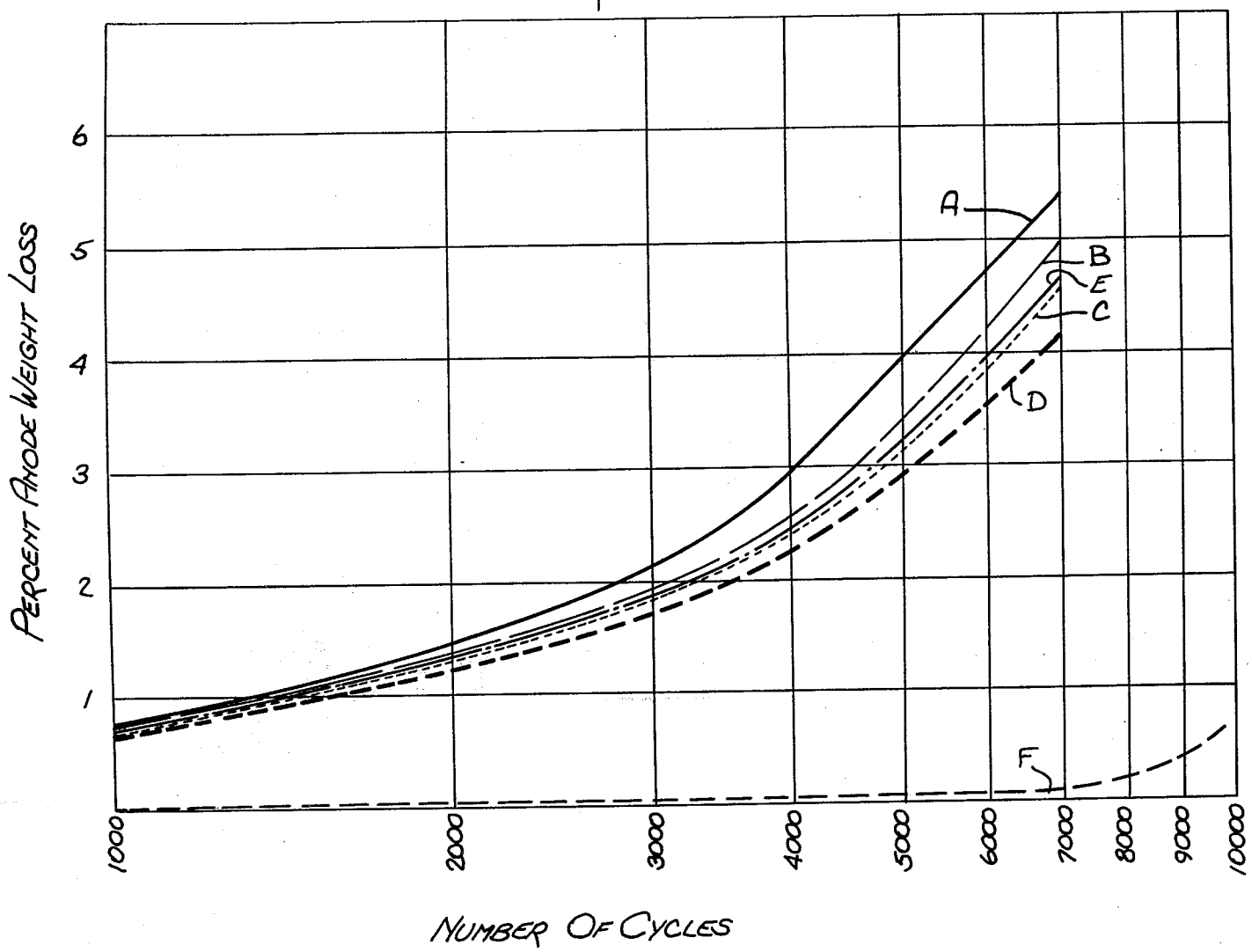

The field of this invention pertains to materials for electrical contacts. Specifically, electrical contact materials comprising gold combined with small amounts of dispersed refractory and rare earth oxides is the subject matter of this invention.

Pure gold, or high karat gold alloys, are extensively used for connector applications. These materials have limited use as make and break contacts because of poor resistance to wear and a tendency to stick or weld at fairly low current values. To meet the requirements of specific applications, such as sensitive relays, instruments, computers, key switches, slip-rings and brushes, radio frequency tuners, and telecommunication applications, a number of special high-content gold alloys have been developed. In most applications, these alloys are used only up to a maximum current level of approximately 0.5 to 2 amperes when long life and low contact resistance are required.

The outstanding electrical contact characteristic of gold is its immunity to the formation of high resistance films of oxides, sulfides, or organic materials. Other advantageous properties are its good electrical conductivity (approx. 73% IACS, International Annealed Copper Standard), low yield point, and low modulus of elasticity, all of which combine to assure a low and stable contact resistance. These properties make it suitable for connectors and for electrical contacts operating at low contact pressure and low current, such as up to 100 to 300 milliamperes. However, the low hardness and low recrystallization temperature of gold lead to excessive mechanical wear, a high tendency for welding and galling, and excessive material loss due to arc erosion when used for make and break contacts at higher current values.

For these reasons most commercial gold contact materials are high-content gold alloys containing other noble metals (e.g., platinum or silver) or base metals (e.g., copper or nickel), in order to provide substantially greater resistance to mechanical wear and to arc erosion. It should be noted that there are two principal factors which limit the amount of alloy additions that can be made to produce these wrought alloys. The first is that the electrical conductivity decreases rapidly with alloy additions; many of these alloys have a conductivity in the range of 4–12% IACS, which limits the current carrying capacity of these materials. The second factor is that alloy additions to gold must be limited in order to retain its outstanding characteristics, such as its resistance to the formation of oxides and films. Thus noble metals and silver additions are generally limited to about 30–40 atomic percent, and base metal additions to 14–18 Kt alloys (58–75 weight percent Au).

Commercial gold alloys developed for specific applications are based on the best compromise of contact erosion, welding tendency, and low contact resistance (noise), and in most applications are generally limited to a maximum current value of 0.5 to 2.0 amperes when long life ($10^6$ to $10^8$ operations) is required. Failure or end-of-life in these applications is generally reached because of (1) formation of a spike and crater erosion pattern, which may lead to bridging the contact gap and result in an interlocking type of weld; (2) actual welding of the contacts, which is considerably enhanced by excessive erosion, or the formation of small molten globules or whiskers on the contact surface and edges; or (3) the development of high and variable contact resistance which results in excessive electrical noise.

It is known that the elevated temperature strength and hardness of metals can be significantly increased by the addition of a finely dispersed stable oxide phase. Theories of dispersion strengthening are well developed and good agreement of experimental data with theory has been observed. However, the effect of these oxides on the important electrical contact characteristics, such as arc erosion, weld tendency, and change in contact resistance, is little known and less understood. Silver-cadmium oxide is a contact material of this type, consisting of CdO dispersed in a silver matrix. However, silver-cadmium oxide is in a special category, since Cdo is not a stable oxide such as is required for dispersion strengthening, particularly at elevated temperature. In silver-cadmium oxide contacts the CdO phase is volatile and decomposes (at approximately 1700°–1750° F) during arcing; this feature gives this material its unique arc-quenching characteristics, especially when used in heavy current applications of 10–50 amps and higher. It should also be noted that these materials contain a fairly high oxide content, usually 10–15%. Even when present in small amounts there is no appreciable strengthening effect of CdO on silver, and above 15% CdO these alloys are too brittle to be fabricated by conventional methods. One of the outstanding properties contributed by CdO to silver is that it decreases the amount of material lost by arc erosion.

It is therefore a general object of this invention to provide an electrical contact made from material which results from the small addition of refractory and rare earth oxides which have been found to have a desirable strengthening effect on gold.

It is a specific object of this invention to provide an electrical contact made from material comprising small additions of refractory and rare earth oxides to gold which reduce the erosion and welding properties of gold contacts while achieving a low and stable surface contact resistance.

SUMMARY OF THE INVENTION

It has been discovered that small additions to substantially pure gold of $CeO_2$ yield a material, superior to pure gold alone, in that electrical contacts made of the material have substantially less arc erosion, much lower tendency for welding and only slightly higher contact resistance. Additions of from 0.1 to 4.0 percent by volume of $CeO_2$ with substantially pure gold yield an outstanding electrical contact material. An addition of 1.0 percent by volume of $CeO_2$ with substantially pure gold is a preferred mixture.

It has been found that an alloy having substantially zero arc erosion when used as an electrical contact material is achieved by the addition to the mixture of gold and $CeO_2$ of one or more oxides characterized by high melting points and a high negative free energy of formation greater than — 80 Kilo calories/gram — atom of oxygen (K cal/g. at. O)

DESCRIPTION OF THE INVENTION

It has been discovered that gold with an oxide dispersion of $CeO_2$ yields a composition having superior and unexpected characteristics which makes it particularly suited as an electrical contact material. It is preferred that the material be prepared in one of two ways: an admixing method or by a decomposition method.

Both methods begin with samples of high purity (99.99 + percent) gold powder. The gold powder is cleaned by boiling it in a solution containing equal parts by volume of HC1 and distilled water. The gold powder is then rinsed with hot distilled water until the wash water is free of chlorine.

In the admixing method the oxide is dispersed in distilled water to form a colloidal solution and the gold powder is added to the solution. This mixture is milled to coat the surface and uniformly distribute oxide particles throughout the gold powder.

The decomposition technique utilizes a solution of at least one metal salt (e.g., nitrate) or of at least one metallo-organic compound which is subsequently converted to the refractory oxide. The gold powder is added to this solution and the mixture is heated and stirred to dryness. By heating the mixture above the thermal decomposition temperature, the salts or metallo-organic compounds are converted to the oxides.

The mixture which results from either of the above methods is then placed in a latex rubber sack and hydrostatically pressed at 30,000 psi to form a bar or sheet. This green compact is then sintered in air at approximately 900° C for about 2 hours and then cooled to room temperature. Sheet material of a plurality of thicknesses between 20 mil and 80 mil can subsequently be achieved by rolling. The materials made in this manner exhibit unexpected characteristics of arc erosion, weld tendency and contact resistance.

Arc erosion is the loss or transfer of material which takes place due to arcing across the contacts. With a.c. current the loss generally takes place on both contacts; however, if one contact reaches a higher temperature, a directional transfer from the hotter to the cooler contact can occur. With d.c. current the material transfer is always highly directional; negative transfer is defined as a build-up of a spike on the cathode with a corresponding crater on the anode, and positive transfer is the formation of a spike on the anode and a crater on the cathode. The direction and amount of transfer that takes place depends upon whether the operating current and voltage conditions are above or below the minimum arcing current and voltage for that material. The minimum arcing current is the highest current that can be interrupted at different voltages without arcing; the minimum arcing voltage is the lowest voltage at which an arc will form at atmospheric pressure. Negative transfer is generally associated with the short arc on make, or when the contacts are operated below the critical arcing current and voltage characteristic for that material; positive transfer is generally associated with the anode arc on break, particularly when the contacts are operated above the critical arcing current and voltage. Negative transfer, frequently called bridge transfer, is generally characterized by sharply local transfer resulting in a tall spike and a deep crater; positive transfer is usually a more desirable type, since it is more diffuse and takes place over a larger area.

One of the common modes of failure of gold and gold alloys in telecommunications and relay contacts is excessive transfer due to arc erosion. Therefore high current d.c. make-arcs, which produce a highly localized negative transfer on gold, are used to evaluate the arc erosion of the various dispersion strengthened gold alloys.

Weld tendency as measured by the number of welds which occur in a given number of operations, and also the maximum weld strength when welding takes place, is another criterion which is used for evaluating the various dispersion hardened gold alloys against pure gold. Gold alloys are limited in many applications because of the tendency for welding, especially at high current levels. When excessive metal transfer takes place in the form of a spike and crater, it may result in an interlocking type of weld; as additional transfer takes place, welding tendency increases rapidly.

The overall resistance of a pair of electrical contacts is the sum of three components: bulk resistance, film resistance, and constriction resistance. Bulk resistance is the normal or ohmic resistance, which is dependent upon the chemical composition of the material and its physical dimensions. It is calculated by multiplying the resistivity of the contact material by its thickness and dividing by the area. Pure gold contacts have low bulk resistance, because of the inherent low resistivity of gold.

Film resistance is the resistance which develops on the surface of an electrical contact due to oxidation, corrosion, or other chemical reactions between the contact material and the surrounding media. This can also include mechanical films that are formed by dirt, dust, oil, or foreign materials. Pure gold has very low film resistance because of its immunity to corrosion and oxidation.

Constriction resistance or surface contact resistance is the resistance across the actual area of contact between the two mating surfaces of the electrical contacts where they touch each other. The actual area of contact is quite small compared to the apparent or geometric area, since no matter how smooth two mating contact surfaces are made, they will still consist of many peaks and valleys, and when they are brought together they will actually touch only at the peaks — called asperities — and these are relatively few in number. Actual measurements of contact resistance generally give values which are equal to ten to twenty times the sum of bulk resistance and film resistance, showing that the surface contact resistance, usually called the constriction resistance, is the most significant component of the total resistance. This is especially true in pure gold and high gold content alloys, since the bulk resistance and film resistance of these alloys are very low. Therefore, the measurement of contact resistance of these alloys essentially indicates the surface contact resistance. A low stable surface contact resistance is one of the outstanding characteristics of gold and high gold-content alloys. This is important in telecommunications, since variation in contact resistance causes electrical noise. This resistance should not exceed a target value (approximately 10–50 milliohms) and should be stable with the number of operations in order to minimize noise. Therefore the initial surface contact resistance, as well as change of resistance during life testing, is an important characteristic of the material.

Table I shows a plurality of materials which have been investigated for their suitability as electrical contact material.

The term alloy is used to indicate a mixture or composition of gold and a particular oxide. The alloy entry A indicates that pure gold was tested along with the compositions in order to provide a basis for evaluation of the parameters.

TABLE I

Dispersion Strengthened Gold Alloys Tested As Electrical Contacts

| Alloy | Composition | Oxide Content % Wt. | Oxide Content % Vol. |
|---|---|---|---|
| A | Au | — | — |
| B | Au + $Y_2O_3$ | .26 | .99 |
| C | Au + $Al_2O_3$ | .18 | .87 |
| D | Au + $ThO_2$ | .20 | .39 |
| E | Au + $TiO_2$ | .24 | 1.07 |
| F | Au + $CeO_2$ | .38 | 1.02 |

The pure gold control sample, A, and the various dispersion strengthened gold alloys, B through F, have been evaluated for arc erosion, welding tendency, and surface contact resistance. Testing equipment was used to carry out life and performance tests for evaluation. The equipment comprises an electro-hydraulic servo-controlled system in which the moving contact is operated through a bellows system at a varied and controlled cyclic rate, contact gap, and velocity against the stationary contact also supported on a bellows system, which is backed up by a temperature controlled dash-pot system.

The effect of make and break arcs on erosion is determined by weight loss of the contacts. The frequency of welding and the actual weld strength is recorded continuously from a transducer system. The contact resistance is measured by means of a low-current system at various contact pressures.

A high current d.c. make-arc was chosen as the test method. An arc current of 80 amperes was selected as the best compromise between welding and arc erosion for arc accelerated life test. Table II indicates test conditions to measure contact properties for the various compositions of Table I.

TABLE II

Experimental Conditions Used For Evaluation Of Electrical Contact Properties of Dispersion Strengthened Gold Alloys

| Variable | Value |
|---|---|
| Velocity (cm/sec) | 2.5 |
| Frequency (Hz) | 0.3 |
| Contact Gap (in.) | 0.150 |
| Contact Overtravel (in.) | 0.070 |
| Make-Force (gm) | 700 |
| Weld Force (gm), max. | 1200 |
| Contact Bounce | None |
| Atmosphere | Air |
| Flow Rate (l/min. of air) | 1 |
| Voltage, open circuit (volts) | 125 |
| Resistance (ohm) | 0.4 |
| Arc Current (amperes) | 80 |
| Make/Break Arc | Make only |

The dispersion hardened gold alloys, along with the pure gold control sample were fabricated into 0.080 inch sheets as described previously. Discs of ⅝ inch diameter were cut from these sheets and then brazed to a standard copper rivet for use in the contact testing equipment. The brazing was carried out in an atmosphere of 95% nitrogen — 5% hydrogen employing a commercially available silver solder. After brazing, the composite contact was machine finished to final diameter and thickness with a 1 inch radius. The test results for the dispersion hardened gold alloys showed improvements in the test parameters over the pure gold sample.

Illustrations are included with this specification to show results of the experiments discussed above. FIG. 1 shows anode weight loss as a function of the number of cycles of operation in the test equipment with electrical contact materials or gold mixed with small amounts of refractory or rare earth oxides.

The curves in FIG. 1 are marked to indicate each gold alloy. The pure gold sample results of the test is shown to indicate the improvements achieved over pure gold. The pure gold showed a pronounced negative transfer, with a cavity in the anode and a spike on the cathode. Negative transfer occurred also with the alloys, except for $CeO_2$ containing alloys. The amount of negative transfer for the several alloys decreased in the order of $Y_2O_3$, $TiO_2$, $Al_2O_3$ and $ThO_2$.

All these alloys did have a cavity in the anode and a spike on the cathode.

Gold with $CeO_2$ was outstanding in regard to arc erosion. After 7000 operations the weight change was less than 0.1%, compared to approximately 4–5% for the other gold alloys, and this weight change was actually anode gain instead of anode loss. The entire nature of the material transfer is quite different for $CeO_2$; the positive transfer occurred over a wide and diffuse area, without a cavity and spike. This type of transfer is desirable, especially when composite contacts are used in commercial devices where the contact thickness must be kept to a minimum because of cost. The arc erosion data on these alloys is summarized in Table III

TABLE III

Anode Loss Due To Arc Erosion After 7000 Operations With An 80 Amp Make-Arc

| Alloy | Anode Loss or (Gain) Weight, mg | Anode Loss or (Gain) % | Relative Wt. Loss (Gain) Ratio |
|---|---|---|---|
| A | 90.6 | 5.4 | 1.00 |
| B | 83.0 | 4.9 | .91 |
| C | 78.7 | 4.5 | .83 |
| D | 85.4 | 4.5 | .83 |
| E | 76.0 | 4.1 | .76 |
| F | 1.1 | (0.1) | (.02) |

The improvement in arc erosion for the various dispersion hardened gold alloys compared to pure gold is shown in the third column, which is the ratio of the weight loss of the dispersion hardened alloy to the weight loss of pure gold. For example, Au + $Y_2O_3$ has a material loss which is 91% of that pure gold, and Au + $TiO_2$ has a material loss of 83% of that of pure gold. The arc erosion resistance of Au + $CeO_2$ is outstanding, since the material transfer with this alloy is about a 2% gain rather than loss as with that of pure gold.

It is important to note that the arc erosion of Au + $CeO_2$ has been found outstanding compared to pure gold, since this alloy has a weight increase of 0.1% compared to gold which has a weight decrease of over 5% under the same test conditions. It is even more significant to note that the Au + $CeO_2$ alloy had a positive material transfer as defined above (i.e. gain of weight on the anode, with loss of weight on the cathode) as compared to the negative material transfer on pure gold (loss of weight on the amode, with gain of weight on the cathode). It can be seen from Table III that although the addition of approximately 1% by volume of each of the oxides in alloy B, C, D, and E reduced the anode loss of gold, the use of 1% by volume of $CeO_2$ was by far the most effective, since it not only eliminated the anode loss but actually resulted in an anode gain. This of course is the ultimate objective for the high gold content contact material. It has been found that increasing the oxide content in alloy B, C, D and E causes further decrease in the anode loss, and increasing the $CeO_2$ content in alloy F increases the anode gain.

Table IV below shows weld data for the alloys discussed above. After 7000 operations, pure gold contacts yielded over 90% welds. The alloys with $Y_2O_3$ and $Al_2O_3$ showed no appreciable improvement in total number of welds. Gold with $ThO_2$ and $TiO_2$ showed substantial improvement in weld frequency. Both of these had about 65% welds at the end of 7000 operations. Again Au + $CeO_2$ was outstanding. It had about five times less welds after 7000 operations as did pure gold.

Table IV also indicates the number of strong welds (% having a weld strength over 1200 gms) which took place with these alloys. Gold with $Y_2O_3$ showed no substantial improvement over pure gold. It had approximately 8–10% strong welds. The $Al_2O_3$ alloy had 4–5% strong welds. The $TiO_2$ alloy had 2–4%, and the $ThO_2$ alloy had 2–3% strong welds. Gold with $CeO_2$ is outstanding with less than 0.1% strong welds over the entire 7000 operations.

TABLE IV

Percentage of Total Welds (100 gms) After 7000 Operations, With An 80-Amp Make Arc

| Alloy | % Total Welds | Ratio to pure gold |
|---|---|---|
| A | 93 | 1.00 |
| B | 93 | 1.00 |
| C | 90 | .97 |
| D | 67 | .72 |
| E | 62 | .66 |
| F | 18 | .19 |

Percentage of Strong Welds (1200 gms) After 7000 Operations, With An 80-Amp Make-Arc

| Alloy | % Strong Welds | Ratio to pure gold |
|---|---|---|
| A | 9.8 | 1.00 |
| B | 9.6 | .98 |
| C | 5.4 | .55 |
| D | 3.0 | .31 |
| E | 2.4 | .25 |
| F | .1 | .01 |

The surface contact resistance data on these alloys, before and after 7000 operations in the test equipment, is summarized in Table V.

TABLE V

Surface Contact Resistance (milliohms) with Make Force (gms) After 7000 Operations, with an 80-Amp Make-Arc

| | Original Resistance | | | | After 7000 Operations | | | |
|---|---|---|---|---|---|---|---|---|
| | Make Force, gms | | | | Make Force, gms | | | |
| ALLOY | 300 | 500 | 700 | 1000 | 300 | 500 | 700 | 1000 |
| A | .14 | .14 | .13 | .11 | .15 | .12 | .10 | .10 |
| B | .15 | .15 | .14 | .12 | .11 | .10 | .10 | .09 |
| C | .16 | .16 | .15 | .13 | .14 | .13 | .12 | .12 |
| D | .20 | .18 | .18 | .16 | .10 | .10 | .10 | .08 |
| E | .10 | .09 | .09 | .08 | .08 | .07 | .07 | .07 |
| F | .17 | .15 | .14 | .12 | .26 | .24 | .23 | .21 |

It can be seen from Table V that the additions of oxides to gold (up to 1% volume) did not have any significant effect on the contact resistance even after 7000 operations, except in the case of $CeO_2$. This material had a contact resistance about twice the other alloys; however, the resistance of approximately 0.20 milliohms after 7000 operations is satisfactory and well below the target of 10 to 50 milliohms: also, this resistance was found to be stable and therefore does not cause excessive noise.

Excessive material loss or gain is not desirable, and the best contact material is one that shows no appreciable material loss by the use of mixed oxides, such as by combining materials with negative material transfer with others that show positive transfer. Equilibrium conditions can be established so that there is little or no net transfer. Since these oxide conditions almost always result in improved welding properties, this makes it possible to obtain alloys with improved arc erosion and welding properties.

Hence, certain additional oxides may be combined with the alloy of gold and $CeO_2$, in order to approximately achieve zero material loss when used as an electrical contact material. These oxides are characterized by their stability or high energy of formation. Table VI which follows contains a list of such oxides which are considered suitable for inclusion in gold and $CeO_2$ alloys. The free energy of formation for each oxide at 25° C is indicated for each suitable oxide.

TABLE VI

Standard Free Energy of Formation Of Selected Oxides at 25° C

| OXIDE | ΔF° (298° K) Kilocalories/gram atom oxygen |
|---|---|
| $Al_2O_3$ | −126 |
| BaO | −126 |
| BeO | −136 |
| CaO | −114. |
| $CeO_2$ | −115 |
| $Cr_2O_3$ | −84 |
| $HfO_2$ | −125 |
| $La_2O_3$ | −136 |
| MgO | −136 |
| $SiO_2$ | −98 |
| $Ta_2O_5$ | −92 |
| $ThO_2$ | −139 |
| $TiO_2$ | −106 |
| $Y_2O_3$ | −133 |
| $ZrO_2$ | −123 |

Multiple oxide alloys with gold are prepared in a manner similar to that described previously. In the admixing method, the $CeO_2$ and the additional oxide or oxides are combined, and the process is followed as described above. In the decomposition technique a solution is made of metal salts or metallo-organic compounds of $CeO_2$ and other metals, the oxides of which are to be combined. The gold powder is added to this solution and the technique is followed as described before.

What is claimed is:

1. An electrical contact made from material comprising a mixture of substantially pure gold and $CeO_2$, wherein said $CeO_2$ comprises from 0.1 to 4.0 percent by volume of said mixture.

2. The electrical contact of claim 1 wherein said $CeO_2$ comprises about one percent by volume of said mixture.

3. The electrical contact of claim 1 further comprising less than 1 percent by volume of one or more oxides characterized by high melting points and a high negative free energy of formation greater than — 80K cal/mole; the specific amount of said one or more oxides being dependent on the amount of percentage by weight of $CeO_2$ to gold, whereby any anode gain of the electrical contact of only $CeO_2$ and gold is substantially reduced to zero.

4. The electrical contact of claim 3 wherein said one or more oxides is selected from the group consisting of $Al_2O_3$, BaO, BeO, CaO, $Cr_2O_3$, $HfO_2$, $La_2O_3$, MgO, $SiO_2$, $Ta_2O_5$, $ThO_2$, $TiO_2$, $Y_2O_3$, and $ZrO_2$.

* * * * *

UNITED STATES PATENT AND TRADEMARK OFFICE

CERTIFICATE OF CORRECTION

PATENT NO. : 4,018,599

DATED : April 19, 1977

INVENTOR(S) : JAMES S. HILL, ET AL.

It is certified that error appears in the above-identified patent and that said Letters Patent are hereby corrected as shown below:

Column 2, line 18, "Cdo" should be changed to --CdO--.

Column 5, line 56, "5/8 inch" should read --3/8 inch--.

Column 6, line 3, "or" should be changed to read --of--.

Column 6, line 64, after the words "loss of" and before the word "gold" insert the word --the--.

Column 8, line 28, under the $\Delta F°$, fourth line down, the figure "-114" should read --144--.

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*